US005119116A

United States Patent [19]

Yu

[11] Patent Number: 5,119,116

[45] Date of Patent: Jun. 2, 1992

[54] THERMAL INK JET CHANNEL WITH NON-WETTING WALLS AND A STEP STRUCTURE

[75] Inventor: Zhao-Zhi Yu, Webster, N.Y.

[73] Assignee: Xerox Corporation, Stamford, Conn.

[21] Appl. No.: 560,845

[22] Filed: Jul. 31, 1990

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 3,683,212 | 8/1972 | Zoltan | 346/140 X |
| 4,367,480 | 1/1983 | Kotoh | 346/140 |
| 4,376,945 | 3/1983 | Hara | 346/140 |
| 4,385,304 | 5/1983 | Sniderman | 346/140 |
| 4,394,670 | 7/1983 | Sugitani | 346/140 |
| 4,422,086 | 12/1983 | Miura et al. . | |
| 4,555,062 | 11/1985 | You . | |
| 4,583,690 | 4/1986 | You . | |
| 4,605,939 | 8/1986 | Hubbard | 346/140 |
| 4,623,906 | 11/1986 | Chandrashekhar et al. . | |
| 4,638,337 | 1/1987 | Torpey | 346/140 |
| 4,643,948 | 2/1987 | Diaz et al. . | |
| 4,728,392 | 3/1988 | Miura et al. . | |
| 4,751,532 | 6/1988 | Fujimura et al. . | |
| 4,774,530 | 9/1988 | Hawkins . | |
| 4,801,955 | 1/1989 | Miura et al. . | |
| 4,829,324 | 5/1989 | Drake et al. . | |
| 4,915,718 | 4/1990 | Desai | 346/140 X |

FOREIGN PATENT DOCUMENTS 193861 8/1986 Japan .

OTHER PUBLICATIONS

Kyser et al.; Design of an Impulse Ink Jet; Journal of Applied Photographic Engineering; vol. 7, No. 3, Jun. 1981, pp. 73–79.

*Primary Examiner*—Joseph W. Hartary
*Attorney, Agent, or Firm*—Oliff & Berridge

[57] ABSTRACT

An ink jet printhead is disclosed which includes at least one nozzle-defining channel having non-wetting walls and a step structure therein. The step structure is arranged within the channel so that the inlet to the channel has a cross-section which is larger in area than a cross-section of the nozzle outlet. The non-wetting walls of the channel prevent ink from being driven towards the outlet nozzle by capillary action as would normally occur with wetting channel walls. By controlling a positive pressure applied to an ink supply, the meniscus of the ink within the channel can be controlled to be located adjacent the step structure of the channel and spaced away from the nozzle outlet. When an actuator, such as, for example, a resistive heating element, is actuated, a droplet of ink will be expelled from the outlet nozzle of the channel. However, since the natural location of the meniscus is spaced from the outlet nozzle, when ink surges forward to refill the channel, no additional ink will weep out of the outlet nozzle. The location of the ink meniscus spaced from the nozzle outlet also inhibits the drying of ink within the channel.

20 Claims, 2 Drawing Sheets

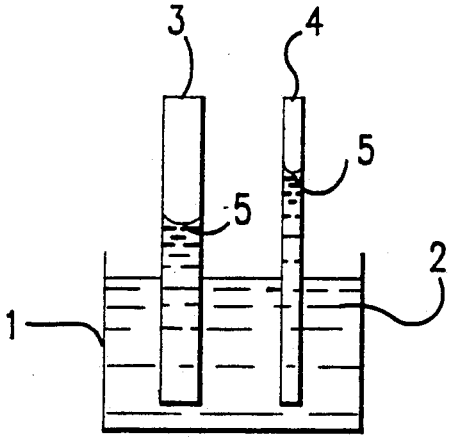
FIG.1A
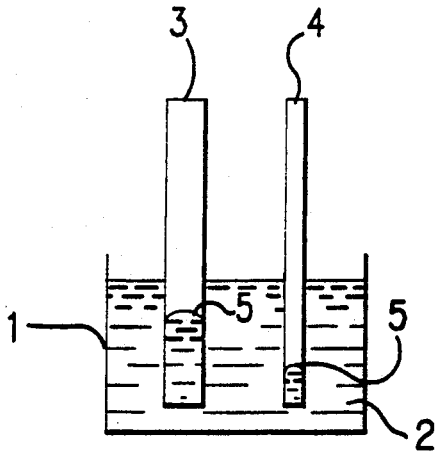
FIG.1B
FIG.2
(PRIOR ART)
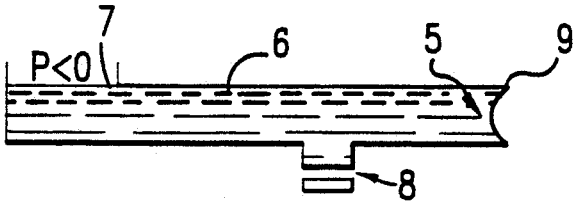
FIG.3A
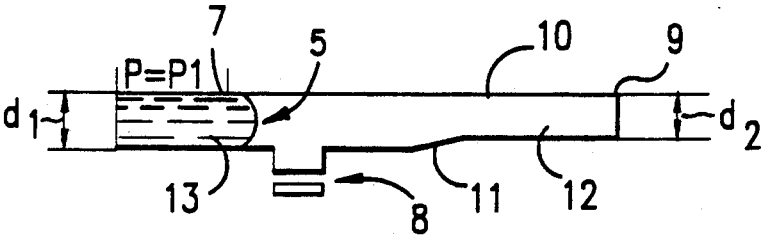
FIG.3B
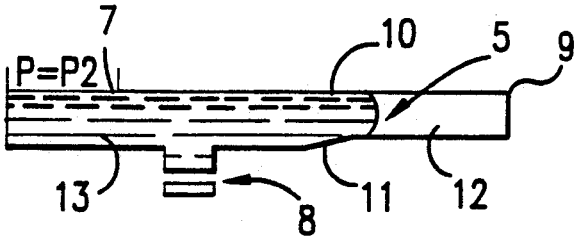
FIG.3C
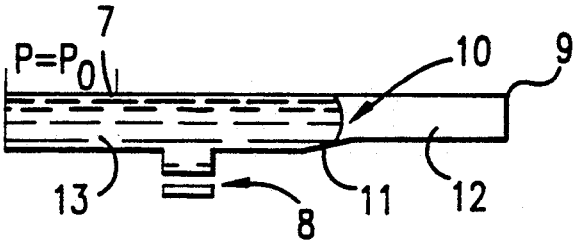

FIG.4
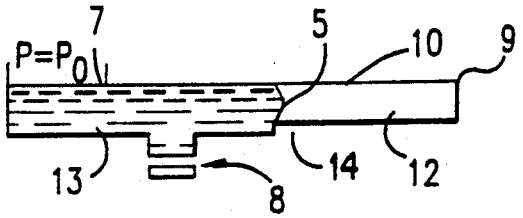
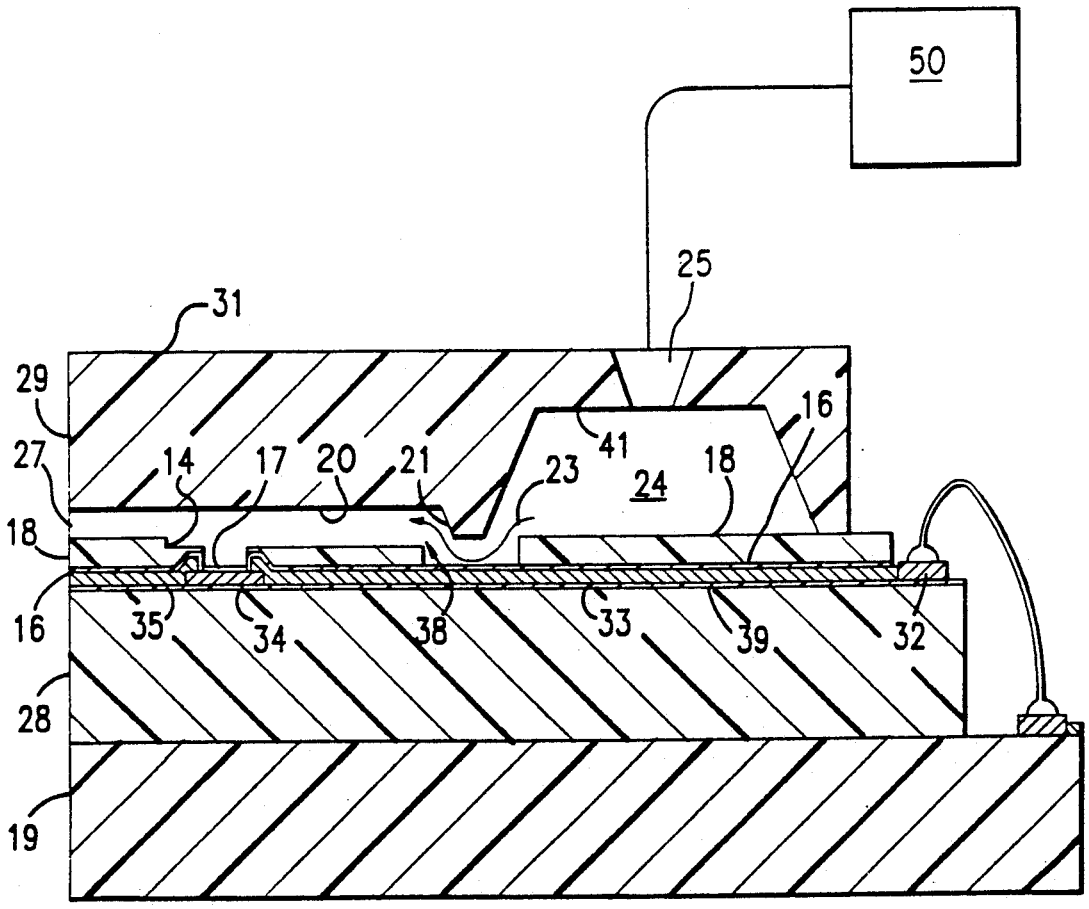
FIG.5

THERMAL INK JET CHANNEL WITH NON-WETTING WALLS AND A STEP STRUCTURE

BACKGROUND OF THE INVENTION

1. Field of the Invention

The present invention relates to ink jet printing, and more particularly, to the structure of nozzle-defining channels included in ink jet printheads.

2. Description of Related Art

In ink jet printing, a printhead is usually provided having one or more ink-filled channels communicating with an ink supply chamber at one end and having an opening at the opposite end, referred to as a nozzle. These printheads form images on a recording medium such as paper by expelling droplets of ink from the nozzles onto the recording medium. The ink forms a meniscus at each nozzle prior to being expelled in the form of a droplet. After a droplet is expelled, additional ink surges to the nozzle to reform the meniscus. An important property of a high quality printhead array is good jet directionality. This ensures that ink droplets can be placed precisely where desired on the print document. Poor jet directional accuracy leads to the generation of deformed characters and visually objectionable banding in half tone pictorial images.

A major source of ink jet misdirection is associated with improper wetting of the front face of the printhead which contains the array of nozzles. One factor which adversely affects jet directional accuracy is the interaction of ink accumulating on the front face of the printhead array with the ejected droplets. Ink may accumulate on the printhead face either from overflow during the refill surge of ink or from the spatter of small satellite droplets during the process of expelling droplets from the printhead. When the accumulating ink on the front face makes contact with ink in the channel (and in particular with the ink meniscus at the nozzle orifice) it distorts the ink meniscus resulting in an imbalance of the forces acting on the egressing droplet which in turn leads to jet misdirection. This wetting phenomenon becomes troublesome after extensive use as the array face oxidizes or becomes covered with a dried ink film. This leads to a gradual deterioration of the image quality that the printhead is capable of generating. In order to retain good ink jet directionality, wetting of the front face desirably is suppressed. Alternatively, if wetting could be controlled in a predictable, uniform manner, jet misdirection would not be a problem. However, uniform wetting is difficult to achieve and maintain.

In thermal ink jet printing, a thermal energy generator, usually a resistor, is located in the channels near the nozzles a predetermined distance therefrom. The resistors are individually addressed with a current pulse to momentarily vaporize the ink and form a bubble which expels an ink droplet. As the bubble grows, the ink bulges from the nozzle and is contained by the surface tension of the ink as a meniscus. The rapidly expanding vapor bubble pushes the column of ink filling the channel towards the nozzle. At the end of the current pulse the heater rapidly cools and the vapor bubble begins to collapse. However, because of inertia, most of the column of ink that received an impulse from the exploding bubble continues its forward motion and is ejected from the nozzle as an ink drop. As the bubble begins to collapse, the ink still in the channel between the nozzle and bubble starts to move towards the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction towards a recording medium, such as paper. The collection of ink on the nozzle-containing face of thermal ink-jet printheads causes all of the problems discussed above.

Ink jet printheads include an array of nozzles and may be formed out of silicon wafers using orientation dependent etching (ODE) techniques. The use of silicon wafers is advantageous because ODE techniques can form structures, such as nozzles, on silicon wafers in a highly precise manner. Moreover, these structures can be fabricated efficiently at low cost. The resulting nozzles are generally triangular in cross-section. Thermal ink jet printheads made by using the above-mentioned ODE techniques are typically comprised of a channel plate which contains a plurality of nozzle-defining channels located on a lower surface thereof bonded to a heater plate having a plurality of resistive heating elements formed on an upper surface thereof and arranged so that a heating element is located in each channel. The upper surface of the heater plate typically includes an insulative layer which is patterned to form recesses exposing the individual heating elements. This insulative layer is referred to as a "pit layer" and is sandwiched between the channel plate and heater plate so that the nozzle-containing face has three layers: the channel plate, the pit layer, and the heater plate. For examples of printheads employing this construction, see U.S. Pat. Nos. 4,774,530 to Hawkins and U.S. Pat. No. 4,829,324 to Drake et al, the disclosures of which are herein incorporated by reference. However, neither of these patents discloses non-wetting nozzle-defining channels having a step structure located between first and second ends thereof so that the channel inlets have a cross-sectional area greater than the cross-sectional area of the nozzle outlets.

In thermal ink jet technology, and in particular with the thermal ink jet printheads constructed from silicon channel plates and heater plates described above, the internal walls of each channel are wetting (wettable). The surface tension between ink in the channel and the wetting channel surfaces always drives the front face of the ink in the channel forward towards the outlet nozzle. Although a negative pressure is applied to the ink supply manifold (by locating the ink supply below the nozzles) to prevent ink from overflowing onto the front face of the chip, ink overflow during the refill process is still a common effect, causing wetting of the printhead front face and thus misdirection problems. Moreover, the front face of the ink is usually right at the outlet nozzle of each channel which results in the rapid drying of ink in the channels during periods of non-use.

The above-mentioned problems have been compensated for in the past by providing maintenance systems for wiping excess ink from the nozzle-containing face of printheads, as well as for capping and humidifying the nozzles during periods of non-use to prevent the drying of ink therein. Since the ink typically has a fast drying rate, it is difficult to prevent some drying from occurring even when a nozzle cap is provided. If the front face of the ink can somehow be held in the middle of each channel consistently, there will not be overflow and chip front face wetting during the refill surge of ink, or associated misdirection problems. Additionally, the ink drying process will be much slower. The maintenance system can then be simplified. Priming, wiping, purging, and even capping might not be necessary.

U.S. Pat. Nos. 4,728,392 and 4,801,955 to Miura et al disclose an electro-pneumatic ink jet printhead which includes a front nozzle having a front channel extending therethrough and aligned with the front channel. Inner and outer surfaces of the front nozzle as well as the surface of the front channel are coated with an ink repellant layer. The front face of the rear nozzle is also coated with an ink repellant layer. The front channel is forwardly tapered. Neither of these patents discloses non-wetting nozzle-defining channels having first ends attachable to an ink supply manifold, second ends defining outlet nozzles, and a step structure located between the first and second ends so that the first end has a cross-section larger in area than a cross-section of the second end, with a constant smaller cross-sectional area of the second end extending a distance from the step structure to the second end.

U.S. Pat. No. 4,422,086 to Miura et al discloses an ink jet printhead comprised of two identical chambers connected to first and second sections of a conduit, a channel for connecting the two chambers and a passageway connecting the channel with the printhead. The transverse cross section of the connecting channel and passageway is smaller than the cross section of the two chambers. However, the step structure is not located between the nozzle outlet and the means for expelling droplets from the nozzle. Additionally, the channels do not have non-wetting surfaces.

U.S. Pat. Nos. 4,555,062 and 4,583,690, both to You, and U.S. Pat. No. 4,643,948 to Diaz et al disclose nozzle-containing faces of ink jet printers which are coated with an anti-wetting agent. None of these patents discloses non-wetting nozzle-defining channels having a step structure located between first and second ends thereof so that the channel inlets have a cross-sectional area greater than a cross-sectional area of the nozzle outlets.

U.S. Pat. No. 4,751,532 to Fujimura et al discloses a thermal electrostatic ink jet recording head wherein thermal energy and an electrostatic field are applied to ink held between two plate members to cause the ink to be jetted out from an orifice defined by the plate members. Critical surface tensions must be satisfied to maintain a desired shape of the meniscus to provide good printing quality. Nozzle-containing surfaces of the plate members are treated to provide different surface tensions. The surfaces may be treated with a silicone-type or fluorocarbon-type resin. Fujimura et al requires that an area surrounding the nozzle remains adherent to liquid. This patent does not disclose non-wetting nozzle-defining channels, or a step structure between inlets and outlets of the channels so that the channel outlets have cross-sectional areas smaller than the channel inlets.

U.S. Pat. No. 4,623,906 to Chandrashekhar et al discloses a surface coating for ink jet nozzles. The coating includes a first layer of silicon nitride, an intermediate layer graded in composition, and a top-most layer of aluminum nitride. Chandrashekhar et al provide this structure to aid in adhering the low wettable, aluminum nitride layer to the nozzle-containing face which is made from glass or silicon. The channel of Chandrashekhar et al does not include a step structure between first and second ends thereof so that a constant smaller cross-sectional area of the second end extends a distance from the step structure to the second end.

OBJECTS AND SUMMARY THE INVENTION

It is an object of the present invention to provide an ink jet printhead having improved ink jet directionality.

It is another object of the present invention to provide an ink jet printhead which reduces the likelihood of ink weeping onto the nozzle-containing face thereof during the ink refill surge.

It is another object of the present invention to provide an ink jet printhead which reduces the likelihood of ink in the nozzle drying during periods of non-use.

It is a further object of the present invention to provide an ink jet printhead which requires a reduced amount of maintenance.

To achieve the foregoing and other objects, and to overcome the shortcomings discussed above, an ink jet printhead is disclosed which includes at least one nozzle-defining channel having non-wetting walls and a step structure therein. The step structure is arranged within the channel so that the inlet to the channel has a cross-section which is larger in area than a cross-section of the nozzle outlet. The non-wetting walls of the channel prevent ink from being driven towards the outlet nozzle by capillary action as would normally occur with wetting channel walls. By controlling a positive pressure applied to an ink supply, the meniscus of the ink within the channel can be controlled to be located adjacent the step portion of the channel and spaced away from the nozzle outlet. When an actuator, such as for example, a resistive heating element, is actuated, a droplet of ink will expelled from the outlet nozzle of the channel. However, since the natural location of the meniscus is spaced from the outlet nozzle, when ink surges forward to refill the channel, no additional ink will weep out of the outlet nozzle.

BRIEF DESCRIPTION OF THE DRAWINGS

The invention will be described in detail with reference to the following drawings in which like reference numerals refer to like elements and wherein:

FIG. 1A is a side view of two tubes having different diameters inserted into a container of liquid and illustrating the location of a meniscus in each tube when the tubes are wetting;

FIG. 1B is a side view of two tubes having different diameters inserted into a container of liquid and illustrating the location of a meniscus in each tube when the tubes are made from a non-wetting material;

FIG. 2 is a cross-sectional view along the length of a thermal ink jet nozzle-defining channel having a substantially constant diameter and a wetting inner surface;

FIGS. 3A–3C are cross-sectional views along the length of a nozzle-defining channel for a thermal ink jet printhead having a step structure so that the inlet of the channel has a larger cross sectional area than the outlet of the channel and illustrating the position of a meniscus within the channel when the ink supply is subjected to different pressures for a non-wetting channel surface;

FIG. 4 is a cross-sectional view along the length of a nozzle-defining channel for a thermal ink jet printhead according to a second embodiment of the present invention; and FIG. 5 is a cross-sectional view along the length of a thermal ink jet printhead fabricated from a channel plate and heater plate illustrating the path for ink to flow from an ink supply manifold to the nozzle.

DETAILED DESCRIPTION OF THE PREFERRED EMBODIMENTS

The present invention makes use of the characteristics of liquids in channels having non-wetting surfaces and applies these characteristics to thermal ink jet printer technology to produce an improved thermal ink jet printer which possesses significant improvements in maintenance and drop directionality. More specifically, the present invention modifies the structure of currently available ink jet printheads so that the natural position of a meniscus of ink within the nozzle-defining channels of the printhead will be within the channel, spaced a distance from the outlet nozzle of the channel. The terminology "natural position" is meant to refer to the position of the meniscus prior to supplying a pulse of electricity to the electro-thermal transducer to vaporize the ink adjacent thereto. The spacing between the meniscus and the nozzle outlet prevents ink from weeping onto the nozzle-containing front face of the printhead during the refill surge of ink and also increases the time required for ink to dry within the channels during periods of non-use.

FIGS. 1A and 1B show two tubes 3 and 4 placed in a container 1 filled with liquid 2. The diameter of tube 3 is greater than the diameter of tube 4. Consequently, the radius of curvature, R, of a meniscus formed in tube 3 is greater than that of a meniscus formed in tube 4. The tubes in FIG. 1A have an internal surface which is wetting whereas the tubes in FIG. 1B have an internal surface which is non-wetting. The location and orientation of a meniscus 5 in each tube 3, 4 is illustrated. As can be seen from FIG. 1A, the surface of the ink is concave for a wetting channel and, as illustrated in FIG. 1B is convex for a non-wetting channel. In both cases, the additional pressure associated with the surface is:

$$P=2a/R$$

where a is the surface tension (surface energy per unit area) and R is the radius of curvature. When R is smaller, the additional pressure P is larger. For a convex surface, the R and thus the additional pressure P are positive, and for a concave surface they are negative. Thus, absent any additional external forces, the liquid is driven from the source of liquid through a wetting channel to place the level of meniscus 5 above the level of liquid 2 in container 1, whereas the level of meniscus 5 is below the level of liquid 2 in container 1 when the internal surface of the channels are non-wetting. This is why a negative pressure is provided in the ink manifold of current thermal ink jet printheads which utilize wetting channels to prevent liquid from continuously flowing out of the nozzles.

FIG. 2 is a cross-sectional view along the length of a nozzle-defining channel of a conventional thermal ink jet printhead. Nozzle-defining channel 6 includes a first end 7 attached to an ink supplying manifold and a second end 9 which defines a nozzle. An electro-thermal transducer 8 is located between the first and second ends of channel 6 and may extend for about one third the channel length. Under normal operating conditions a slight negative pressure $P<0$ is provided on ink in an ink reservoir by, for example, placing the ink supply container at a level slightly below the horizontal level of the nozzles 9 of the printer. Under these conditions, a meniscus 5 will form just at the second end of channel 6 adjacent nozzle 9. When transducer 8 is supplied with a pulse of electricity, the ink adjacent transducer 8 momentarily vaporizes to cause a droplet of ink to be expelled from nozzle 9. As stated earlier, as transducer 8 cools, ink will move from the ink reservoir to refill the now vacated portion of channel 6 by capillary action. This ink refill surge can cause some ink to weep onto the nozzle-containing face of the printhead. The collection of ink on the front face of the printhead can cause misdirection problems and requires maintenance of the printhead such as wiping and cleaning. Additionally, since the meniscus, or front face 5 of the ink in channel 6 is located at the outlet nozzle 9, the ink is susceptible to drying during periods of non-use which requires further maintenance.

FIG. 3A–3B are cross sectional views along the length of a nozzle-defining channel 10 of a thermal ink jet printhead according to a first embodiment of the present invention. Channel 10 includes a first end 7 which is capable of being placed in fluid communication with a source of ink and a second end 9 which defines a nozzle. Unlike previous thermal ink jet channels, channel 10 has an internal surface which is coated with a non-wetting material and also includes a step structure 11 between its first and second ends so that the diameter $d_1$ of the first end is larger than the diameter $d_2$ of the second, or nozzle-defining end. Thus, the cross sectional area of the first end 7 is also larger than the cross sectional area of the second end 9 of channel 10. Since the pressure, P, required to counter-balance the additional pressure associated with the meniscus in a non-wetting channel increases as the diameter of the channel decreases, the step structure 11 is utilized to separate channel 10 into a front section 12 which has a smaller diameter and cross section than a rear section 13. This step structure 11 and the different cross-sectional areas of front portion 12 and rear portion 13 permits the location of a meniscus of ink 5 within channel 10 to be controlled so that it is spaced from nozzle 9 and located between nozzle 9 and transducer 8.

Assuming the positive pressure needed to push the ink into the rear portion 13 is P1, and the positive pressure needed to push the ink into the front portion 12 is P2, P2 will be larger than P1. If an intermediate pressure $P_0$, wherein $P2>P_0>P1$, is applied to the ink supply, the meniscus or front face 5 of the ink in channel 10 will be pushed and then held onto the step structure 11. $P_0$ is preferably in the range between 1 and 8 inches of water. To cut down the ink drying rate significantly, the length of the front portion 12, that is, the length between nozzle 9 and step structure 11, should be in the order of about 100 microns. The step structure 11 shown in FIGS. 3A–3C is a gradual taper in the surface of channel 10 which separates front, or downstream portion 12 of channel 10 from rear, or upstream portion 13 of channel 10. Alternatively, the rear portion of the channel may be of reduced cross section, thereby requiring a priming pressure to force ink into the channel. After priming, the pressure $P_0$ is maintained on the ink in the channel and the ink meniscus stays at the step 11.

FIG. 4 shows a second embodiment of the present invention wherein the step structure is a sharp step 14 instead of a tapered step 11. The sharp step 14 extends at an angle of about 90° to the longitudinal axis of channel 10. Sharp step 14 is preferred to tapered step 11 because the location of front face or meniscus 5 of the ink can be more precisely controlled with a sharp step. The optimal dimension of the step structure can obviously be determined by numerical modeling or by experiments.

FIG. 5 is a cross-sectional view through a nozzle-defining channel along the length of a thermal ink jet printhead made from a heater plate 28 and a channel plate 31 according to the second embodiment of the present invention. The thermal ink jet printhead is similar to that disclosed in the above-incorporated U.S. Pat. No. 4,774,530 to Hawkins, except that a rear portion of channel 20 is widened so that a sharp step 14 is formed between nozzle outlet 27 and resistive heating element 34. The remaining structure of the printhead is similar to that disclosed in the above-incorporated U.S. Pat. No. 4,774,530. While the illustrated components of the thermal ink jet printhead will be described below, a more detailed description of the materials which can be used to fabricate thermal ink jet printheads as well as the methods of placing the various grooves, channels and through-holes in channel plate 31 can be ascertained from the above-incorporated patents as well as U.S. Pat. No. 4,463,359 to Ayata et al, U.S. Pat. No. 4,601,777 to Hawkins et al. U.S. Pat. No. 4,863,560 to Hawkins and U.S. Pat. No. 4,851,371 to Fisher et al, the disclosures of which are herein incorporated by reference. These patents disclose basic orientation dependent etching (ODE) techniques, along with other techniques, such as milling, for forming grooves and through-holes in silicon wafers which are used to form channel plate 31. These patents also disclose basic semiconductor technology for forming electrical structures on substrates, such as, for example, silicon wafers used to fabricate heater plates 28. Thus, while a specific ink jet printhead is shown and described, the present invention is applicable to other ink jet printhead constructions where it is desirable to locate the meniscus of a column of ink, used to form droplets, spaced from the nozzle outlet.

Heater plate 28 includes a plurality of heating elements 34 and addressing electrodes 33 patterned on a first surface thereof. The upper substrate or channel plate 31 has a plurality of parallel grooves 20 which extend in one direction and penetrate through the upper substrate front face edge 29 at second ends thereof. The other or first ends of grooves 20 terminate at slanted wall 21. The floor 41 of the internal recess 24 which is used as the ink supply manifold for channels 20, has an opening 25 therethrough for use as an ink fill hole. The first surface of channel plate 31 (i.e., the surface having the grooves) is aligned and bonded to the heater plate 28, so that a respective one of the plurality of heating elements 34 is positioned in each channel, formed by the channel plate grooves and the lower substrate or heater plate 28. Ink enters the manifold formed by the recess 24 and the lower substrate 28 through the fill hole 25 and, by applying a controlled positive pressure, in the range between 1 and 8 inches of water, preferably about one inch of water, to the ink supplied to manifold 24 through fill hole -52, fills channel 20 up to stepped portion 14 by flowing through an elongated recess 38 formed in a thick film insulative layer 18. Thick film insulative layer 18 can be formed from a thick film organic structure such as, for example, Vacrel ®, Riston ®, Probimer 52 ® or polyimide and will described in more detail below. Unlike previous printheads, prior to using the printhead of the present invention, a non-wetting material is pushed through channels 20 from manifold 24 so that the internal surface of each channel 20 becomes coated, and thus non-wetting. Thus, instead of travelling to nozzle 27 via capillary action, the meniscus will stop and be controllably located at step structure 14 as shown in FIG. 4.

The addressing electrodes 33 on the lower substrate or heater plate 28 terminate at terminals 32. The upper substrate or channel plate 31 is smaller than the lower substrate in order that the electrode terminals 32 are exposed and available for wire bonding to the electrodes on the daughterboard 19 on which the printhead is permanently mounted. Layer 18 is a thick film passivation layer, discussed later, sandwiched between upper and lower substrates. This layer is etched to expose the heating elements 34, thus placing them in a pit, and is also etched to form the elongated recess 38 to enable ink flow between the manifold 24 and the ink channels 20. In addition, the thick film insulative layer 18 is etched to expose the electrode terminals 32 of heater plate 28. The structure of the printhead is similar to that disclosed in the above-incorporated U.S. Pat. No. 4,774,530 except that the pit is extended towards manifold 24 and towards nozzle outlet 27 so that a rear portion of channel 20 has a larger cross-sectional area than a front portion of channel 20 which includes outlet nozzle 27. The printhead also differs from that shown in the above-incorporated patent in that the inner surface of channel 20 is made non-wetting.

FIG. 5 also illustrates how the ink flows from the manifold 24 and around the end 21 of groove 20 as depicted by arrow 23. As is disclosed in U.S. Pat. No. 4,638,337 to Torpey et al, a plurality of sets of bubble generating heating elements 34 and their addressing electrodes 33 are patterned on the polished surface of a single side polished (100) silicon wafer. Prior to patterning the multiple sets of printhead electrodes 33, the resistive materials that serve as heating elements 34, and the common return 35, the polished surface of the wafer is coated with an underglaze layer 39 such as silicon dioxide, having a thickness of about 2 micrometers. The resistive material may be a doped polycrystalline silicon which may be deposited by chemical vapor deposition (CVD) or any other well known resistive material such as zirconium boride ($ZrB_2$). The common return 35 and the addressing electrodes 33 are typically aluminum leads deposited on the underglaze 39 and over the edges of the heating elements 34. The common return ends or terminals and addressing electrode terminals are positioned at predetermined locations to allow clearance for wire bonding to the electrodes (not shown) of the daughterboard 19, after the channel plate 31 is attached to make a print head. The common return 35 and the addressing electrodes 33 are deposited to a thickness of 0.5 to 3 micrometers, with a preferred thickness being 1.5 micrometers.

In the preferred embodiment, polysilicon heating elements are used and a silicon dioxide thermal oxide layer 17 is grown from the polysilicon in high temperature steam. The thermal oxide layer is typically grown to a thickness of 0.5 to 1 micrometer to protect and insulate the heating elements 34 from the conductive ink. The thermal oxide is removed at the edges of the polysilicon heating elements for attachment of the addressing electrodes 33 and common return 35, which are then patterned and deposited. For electrode passivation, a two micrometer thick phosphorous doped CVD silicon dioxide film 16 is deposited over the entire wafer surface, including the plurality of sets of heating elements and addressing electrodes. The passivation film 16 provides an ion barrier which will protect the exposed electrodes from the ink. Other ion barriers may be used, such as, for example, polyimide, plasma nitride, as well as the above-mentioned phosphorous doped silicon dioxide, or any combinations thereof. An effective ion barrier layer is achieved when its thickness is between 1000 angstrom and 10 micrometers, with the preferred thickness being 1 micrometer. The passivation film or layer 16 is etched off of the terminal ends of the common return and addressing electrodes for wire bonding later with the daughterboard electrode. This etching of the silicon dioxide film may be by either the wet or dry etching method. Alternatively, the electrode passivation may be accomplished by plasma deposited silicon nitride ($Si_3N_4$).

Next, a thick film type insulative layer 18 such as for example Riston ®, Vacrel ®, Probimer 52 ®, or polyimide is formed on the passivation layer 16 having a thickness of between 10 and 100 micrometers and preferably in the range of 25 to 50 micrometers. The insulative layer 18 is photolithographically processed to enable etching and removal of those portions of the layer 18 over heating elements 34 (forming a recess) as well as rearward and forward of the heating elements 34 so that a rear portion of channel 20, which is formed when channel plate 31 is bonded to heater plate 28, is larger in cross-sectional area than a front portion of channel 20. Thick film insulative layer 18 is also removed to form an elongated recess 38 for providing an ink passage from the manifold 24 to the ink channels 20. Thus, the passivation layer 16 alone protects the electrodes 33 from exposure to the ink in this elongated recess 38. The entire insulative layer 18 or only a portion of the thickness thereof can be removed from a length of the heater plate 28 located adjacent each channel 20. The portion of layer 18 which is removed can extend from heating element 34 all the way to passage 38 or only most of the way thereto. Additionally, a portion of layer 18 between heating element 34 and nozzle 27 is removed so that the meniscus of ink will be located between nozzle 27 and heating element 34. As stated earlier, in order to effectively increase the time required for ink in channels 20 to dry during periods of non-use, the step structure, whether it be a tapered step or a sharp step, should be located 100 microns from nozzle 27. The step structure must be between nozzle 27 and heating element 34 so that some ink will be expelled from nozzle 27 upon application of an electric impulse to the heating element 34.

After etching insulative layer 18, a channel plate 31 prepared by orientation etching techniques to fabricate a plurality of parallel grooves as well as an ink manifold 24 and fill hole 25 therethrough is attached to heater plate 28 so that each resistive heating element 34 is located in a corresponding groove to form a channel 20.

In order to render the nozzle-defining channels 20 non-wetting, a non-wetting coating material is pushed from the ink manifold 24 through all of the channels 20 to make all of the channel walls non-wetting or is applied separately to the channel surfaces before the channel plate and heater plate are joined together. Any well known non-wetting coating material can be used as long as it adheres well to silicon and polyimide or any other material which makes up the internal channel walls. Preferred materials include Rain-X ® (polydimethyl siloxane dissolved in ethanol and acidified with a few percent sulfuric acid) from Unelko Corp., polytetrafluoroethylene, L1668 and fluorinated diamond-like carbon. Of course, other non-wetting coating materials can also be used with the present invention.

While the above-described embodiment forms the step structure by removing a portion of insulative material layer 18 from a portion of the heater plate 28 located adjacent the rear portion of channel 20, other methods of forming the step structure with a printhead of the type illustrated in FIG. 5 are also available. For example, the portion of insulative layer 18 located adjacent the front portion of channel 20 can be built-up so that the cross-sectional area of the front portion of channel 20 is less than the cross-sectional area of the rear portion of channel 20. However, it is difficult to align the channel plate 31 with the heater plate 28 because the built-up portions of the heater plate must fit precisely within each channel-defining groove in the lower surface of channel plate 31. As a second alternative, the rear portion of the channel defining groove in the channel plate 31 can be enlarged using orientation dependent etching techniques. The use of ODE to increase the size of the rear portion of the channel-defining groove requires an additional mask to be applied to and etching step to be performed on the channel plate wafer and is thus not as simple and straight forward as the method described and illustrated in FIG. 5. Since a portion of insulative layer 18 located above resistive heating element 34 must be removed, the removal of additional portions of insulative layer 18 can be accomplished without any additional manipulative steps, but merely requires increasing the size of the aperture in the mask used to remove material from over heating element 34.

By providing a step structure between the outlet nozzle and electro-thermal transducer (or other actuating means) of an ink jet printhead, the front face or meniscus of ink can be precisely located within the channel spaced a predetermined distance from the outlet nozzle. This spacing prevents ink from weeping onto the nozzle-containing front face of the printhead during the ink refill surge and also reduces the likelihood of ink in the nozzle-defining channels from drying during periods of non-use. It has been observed that thermal ink jet printheads fabricated according to the present invention, can be controlled and actuated in the same manner as previous printheads which used wetting channels without a step structure therein. Accordingly, the ink supply container 50 (see FIG. 5) for supplying ink to the printheads is located at an appropriate elevation, relative to the printhead nozzles, to supply ink at the appropriate positive pressure to the nozzles. Thus, no changes need to be made in the control hardware and software of thermal ink jet printheads using the present invention. Additionally, it has been observed that the velocity of the ink droplets expelled from thermal ink jet printheads employing the present invention is higher than the velocity of ink droplets expelled from conventional wetting thermal ink jet printheads. Since ink does not extend completely to the nozzle of the channel prior to actuation of the heating elements, less ink is located between the channel and heating element in printheads made according to the present invention than in conventional wetting printheads. Thus, the force provided by the momentary bubble which is created when the heating element is actuated is imparted to a smaller quantity of ink with the present invention so that the ink ejected from the printhead nozzle will have a higher velocity. The higher velocity of the ink droplets is desirable because they are less susceptible to misdirection forces and also permits the printhead to be located further away from the recording medium if desired. Locating the printhead further away from the recording medium reduces the likelihood of ink splattering onto the front face of the printhead when the ink droplets impact the recording medium. The increased velocity of the ink droplets also reduces errors created by the differences in distance which some droplets must travel when the recording medium (such as paper) is conveyed in front of the printhead on a curved platen.

It has also been observed that providing a step structure and non-wetting surface in the nozzle-defining channels of a thermal ink jet printhead improves the quality of the text formed by the printhead and facilitates the use of printheads having smaller diameter nozzles. The use of printheads having smaller diameter nozzles also improves the quality of the outputted text because smaller drops capable of more detail are expelled therefrom. Conventional thermal ink jet printheads are fabricated to produce 300 spots per inch (spi). In an attempt to improve the quality of the text outputted by these printheads, it has been proposed to fabricate printheads capable of outputting 600 spi. One design employed to create 600 spi utilized the same heater plates used for 300 spi printheads (i.e., the heater plates included an array of heating elements having a density of 300 per inch) but the channel plates had grooves which were smaller in cross-sectional area than previous channel plates. Two such printheads capable of outputting smaller than previous size ink droplets of a density of 300 spi were then arranged so that the nozzles of each printhead were staggered. The combined printheads thus formed a resulting line of ink spots having a density of 600 spi. Additionally, since printheads having nozzle-defining channels according to the present invention do not require the ink to refill the front, or smaller portion of the channel, the fact that the front portion is made smaller than previous designs has no affect at all on a printhead fabricated according to the present invention. Thus, the present invention also facilitates the fabrication of thermal ink jet printheads capable of producing smaller ink spots at a higher density than was previously available.

While the invention has been described with reference to particular preferred embodiments, the invention is not limited to the specific examples given. For example, other materials can be used to fabricate the ink jet printheads, and if those materials are non-wetting, they need not be coated with a non-wetting material. Other embodiments and modifications can be made by those skilled in the art without departing from the spirit and scope of the attached claims.

What is claimed is:

1. An ink jet printhead comprising:

at least one channel having first and second ends, said first end being attachable to an ink supply manifold, said second end forming an outlet nozzle, an entire surface of said channel from said first end to said second end being non-wetting, said surface of said channel having a step structure located between said first and second ends so that said first end has a cross-section larger in area than a cross-section of said second end, a constant smaller cross-sectional area of the second end extending a distance from said step structure to said second end;

actuating means, located in said channel between said first end and said step structure, for expelling droplets of ink from said outlet nozzle;

an ink manifold, attached to said first end, for supplying ink to said at least one channel; and pressure means for applying a positive pressure to ink within said ink manifold so that a meniscus forms in said at least one channel at said step structure spaced from said outlet nozzle.

2. The printhead according to claim 1, wherein said step structure is a gradual, tapered step in at least a portion of said surface of said channel.

3. The printhead according to claim 1, wherein said step structure is a sharp step in at least a portion of said surface of said channel.

4. The printhead according to claim 1, wherein said actuating means includes a resistive heating element located in a wall of said channel between said first end and said step structure.

5. The printhead according to claim 1, wherein said pressure means applies a positive pressure $P_0$, which is determined according to the formula:

$$P_2 > P_0 > P_1 > 0.$$

wherein $P_2$ is a pressure which locates a meniscus in the channel between said step structure and said second end and $P_1$ is a pressure which locates a meniscus in the channel between said step structure and said first end.

6. The printhead according to claim 1, wherein said pressure means applies a positive pressure of about 1 to 8 inches of water to said ink manifold.

7. A thermal ink jet printhead comprising:

at least one channel having an internal surface and first and second ends, said first end being attachable to an ink supply manifold, said second end forming an outlet nozzle, said entire internal surface of said channel from said first end to said second end being non-wetting, said internal surface also having a step structure located between said first and second ends so that said first end has a cross-section larger in area than a cross-section of said second end, a constant, smaller cross-sectional area of said second end extending a distance from said step structure to said second end;

an electro-thermal transducer, located in said channel between said first end and said step structure, for temporarily vaporizing ink in said channel adjacent said transducer to cause a droplet of ink to be expelled from said outlet nozzle;

an ink manifold, attached to said first channel end, for supplying ink to said plurality of channels; and pressure means for applying a positive pressure to ink within said ink manifold so that a meniscus forms in said channels at said step structure spaced from said outlet nozzles.

8. The printhead according to claim 7, wherein said step structure is a gradual tapered step in at least a portion of said surface of said channel.

9. The printhead according to claim 7, wherein said step structure is a sharp step in at least a portion of said surface of said channel.

10. The printhead according to claim 7, wherein said pressure means applies a positive pressure $P_0$, which is determined according to the formula:

$$P_2 > P_0 > P_1 > 0,$$

wherein $P_2$ is a pressure which locates a meniscus in the channel between said step structure and said second end and $P_1$ is a pressure which locates a meniscus in the channel between said step structure and said first end.

11. The printhead according to claim 10, wherein said pressure means applies a positive pressure of about one inch of water to said ink manifold.

12. The printhead according to claim 7, wherein said electro-thermal transducer includes a resistive heating element.

13. A thermal in jet printhead comprising:

a first substrate having a plurality of electrothermal transducers on a first surface thereof;

a second substrate having a plurality of grooves, corresponding in number and location to said plurality of transducers, formed in a first surface thereof, said grooves having first and second ends, each of said first ends being attachable to an ink supply manifold and each of said second ends extending to an edge of said second substrate, said first and second substrates being attached to each other with their first surfaces contacting each other so that an electro-thermal transducer is located in each groove spaced a distance from said second end of each groove to form a plurality of channels, each channel being attachable to an ink supply manifold at first end which corresponds to said groove first end and having an outlet nozzle at a second end which corresponds to said groove second end;

one of said plurality of grooves and said first surface of said second substrate which corresponds to said plurality of grooves having a step structure, located between said first and second channel ends, so that said first end of said channel has a cross-section larger in area than a cross-section of said channel second end, a constant, smaller cross-sectional area of said second channel end extending a distance from said step structure to said channel second end, an entire surface of said channel from said first channel end to said second channel end being non-wetting;

an ink manifold, attached to said first channel end, for supplying ink to said plurality of channels; and pressure means for applying a positive pressure to ink within said ink manifold so that a meniscus forms in said channels at said step structure spaced from said outlet nozzle.

14. The printhead according to claim 13, wherein said step structure is formed on said first substrate.

15. The printhead according to claim 13, wherein said first and second substrates are made from silicon, said channel including a non-wetting coating therein.

16. The printhead according to claim 13, wherein said step structure is a gradual tapered step in at least a portion of said surface of said channel.

17. The printhead according to claim 13, wherein said step structure is a sharp step in at least a portion of said surface of said channel.

18. The printhead according to claim 13, wherein said pressure means applies a positive pressure $P_0$, which is determined according to the formula:

$$P_2 > P_0 > P_1 > 0,$$

wherein $P_2$ is a pressure which locates a meniscus in the channel between said step structure and said second channel end and $P_1$ is a pressure which locates a meniscus in the channel between said step structure and said first channel end.

19. The printhead according to claim 13, wherein said pressure means applies a positive pressure of about 1 to 8 inches of water to said ink manifold.

20. The printhead according to claim 13, wherein said electro-thermal transducer includes a resistive heating element.

* * * * *